US009963927B1

(12) United States Patent
Dudley

(10) Patent No.: US 9,963,927 B1
(45) Date of Patent: May 8, 2018

(54) SYSTEMS, DEVICES, AND/OR METHODS FOR MANAGING OBJECTS

(71) Applicant: Garrett Dudley, Palmyra, VA (US)

(72) Inventor: Garrett Dudley, Palmyra, VA (US)

( * ) Notice: Subject to any disclaimer, the term of this patent is extended or adjusted under 35 U.S.C. 154(b) by 0 days. days.

(21) Appl. No.: 15/691,573

(22) Filed: Aug. 30, 2017

Related U.S. Application Data

(60) Provisional application No. 62/449,002, filed on Jan. 21, 2017, provisional application No. 62/470,102, filed on Mar. 10, 2017.

(51) Int. Cl.

| | |
|---|---|
| ***A47B 81/00*** | (2006.01) |
| ***E05G 1/026*** | (2006.01) |
| ***A47G 1/06*** | (2006.01) |
| ***E05G 1/024*** | (2006.01) |

(52) U.S. Cl.
CPC ..... *E05G 1/026* (2013.01); *A47G 1/06* (2013.01); *E05G 1/024* (2013.01); *A47B 81/005* (2013.01); *E05Y 2900/20* (2013.01)

(58) Field of Classification Search
CPC ..... A47G 1/06; E05G 1/024; E05G 1/026; A47B 81/00; A47B 81/005; E05Y 2900/202; E05Y 2900/20
USPC ..... 312/310
See application file for complete search history.

(56) References Cited

U.S. PATENT DOCUMENTS 4,155,608 A * 5/1979 Orlewicz ..... A47B 81/005 109/51
4,304,447 A * 12/1981 Ellwood ..... A45C 11/16 312/204
4,936,038 A * 6/1990 Johnson ..... A47B 81/005 211/64
5,111,755 A * 5/1992 Rouse ..... A47B 81/005 109/25
5,118,175 A * 6/1992 Costello ..... F41C 33/06 206/317
5,329,865 A * 7/1994 McWard ..... A47B 46/005 108/93
5,901,589 A * 5/1999 Cordero ..... E05G 1/00 109/59 R
5,987,941 A * 11/1999 Zocco ..... A47B 81/005 109/59 R
6,405,861 B1 * 6/2002 Siler ..... F41C 33/06 206/1.5
6,843,081 B1 * 1/2005 Painter ..... F41C 33/06 109/45
7,178,370 B2 * 2/2007 Engel ..... F41A 17/066 109/50
8,430,461 B1 * 4/2013 Cole ..... E05B 65/46 312/204
2007/0241010 A1 * 10/2007 Giebel ..... A47B 81/00 206/317
2010/0212372 A1 * 8/2010 Wolfe ..... A47B 81/00 70/78
2014/0103785 A1 * 4/2014 Richards ..... A47B 81/005 312/204

(Continued)

*Primary Examiner* — Daniel J Rohrhoff
(74) *Attorney, Agent, or Firm* — Dale Jensen, PLC; Dale R. Jensen

(57) ABSTRACT

Certain exemplary embodiments can provide a system. The system can comprise a frame, a slidable cover; a cabinet, and/or a drawer coupled to the cabinet, etc. In certain exemplary embodiments, when the slidable cover is lifted to a predetermined position, the drawer rotates. When the drawer rotates, an object comprised by the drawer can be exposed.

16 Claims, 16 Drawing Sheets

(56) References Cited

U.S. PATENT DOCUMENTS

| | | | | |
|---|---|---|---|---|
| 2015/0033994 | A1* | 2/2015 | Popwell | E05G 1/10 109/43 |
| 2016/0166072 | A1* | 6/2016 | Edwards | A47B 81/005 5/308 |
| 2016/0326792 | A1* | 11/2016 | Hjort | E05G 1/04 |

* cited by examiner

8000

SYSTEMS, DEVICES, AND/OR METHODS FOR MANAGING OBJECTS

CROSS-REFERENCES TO RELATED APPLICATIONS

This application claims priority to, and incorporates by reference herein in its entirety, U.S. Provisional Patent Application Ser. No. 62/449,002, filed Jan. 21, 2017. This application also claims priority to, and incorporates by reference herein in its entirety, U.S. Provisional Patent Application Ser. No. 62/470,102, filed Mar. 10, 2017.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a system. The system can comprise a frame, a slidable cover; a cabinet, and/or a drawer coupled to the cabinet, etc. In certain exemplary embodiments, when the slidable cover is lifted to a predetermined position, the drawer rotates. When the drawer rotates, an object comprised by the drawer can be exposed.

Certain exemplary embodiments provide a cabinet that can be used to store certain objects in a concealed manner. For example, a user of the cabinet can store a firearm such as handgun in the cabinet. The firearm stored in the cabinet will remain substantially concealed in the cabinet until a front cover of the cabinet is raised above a predetermined level. A drawer that holds the objects (e.g., handgun) is constructed to swing forward when the front cover of the cabinet is raised above a predetermined level. For example, the drawer can be mounted to the cabinet via dowel pins or any other method allowing the drawer to swing forward with the front cover is lifted. A weight distribution of the drawer can be constructed such that the weight of an upper portion of the drawer causes the drawer to swing forward when the front cover is lifted.

Figure 1:
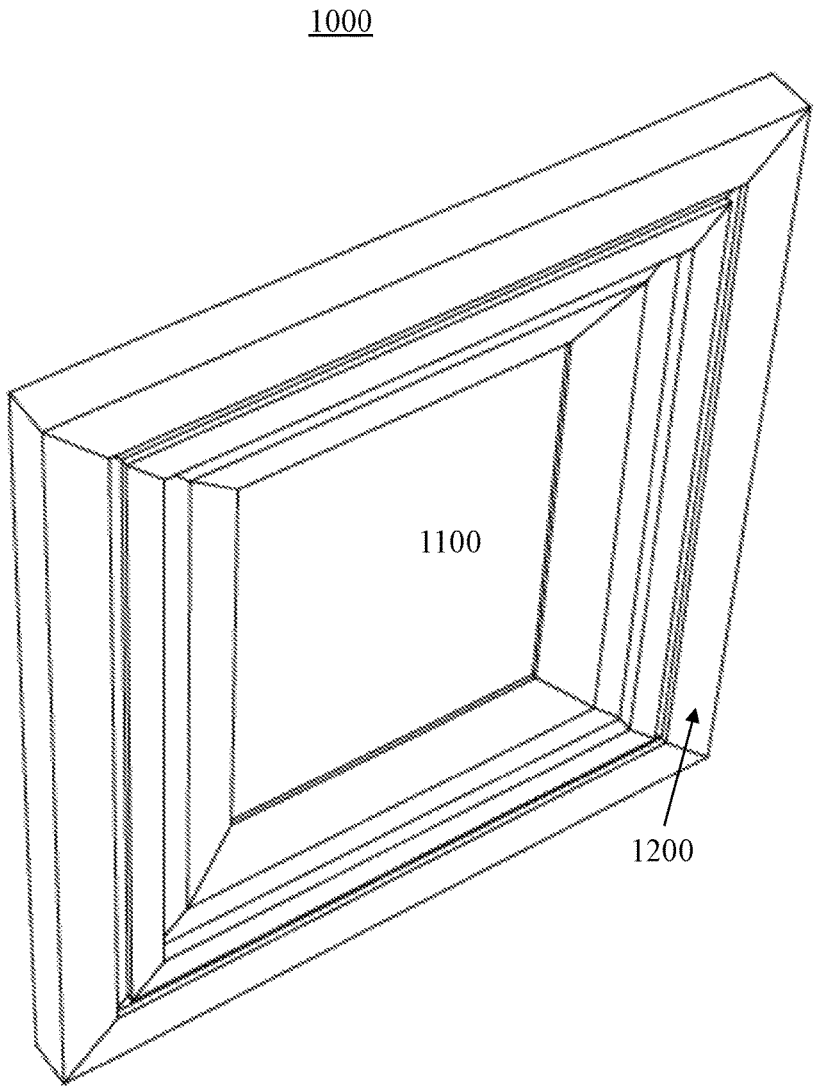
FIG. 1 is a perspective view of an exemplary embodiment of a system 1000.

FIG. 1 is a perspective view of an exemplary embodiment of a system 1000, which comprises a front cover 1100 and a frame 1200. Front cover 1100 and frame 1200 can be slidably coupled via a tongue and groove design.

Figure 2:
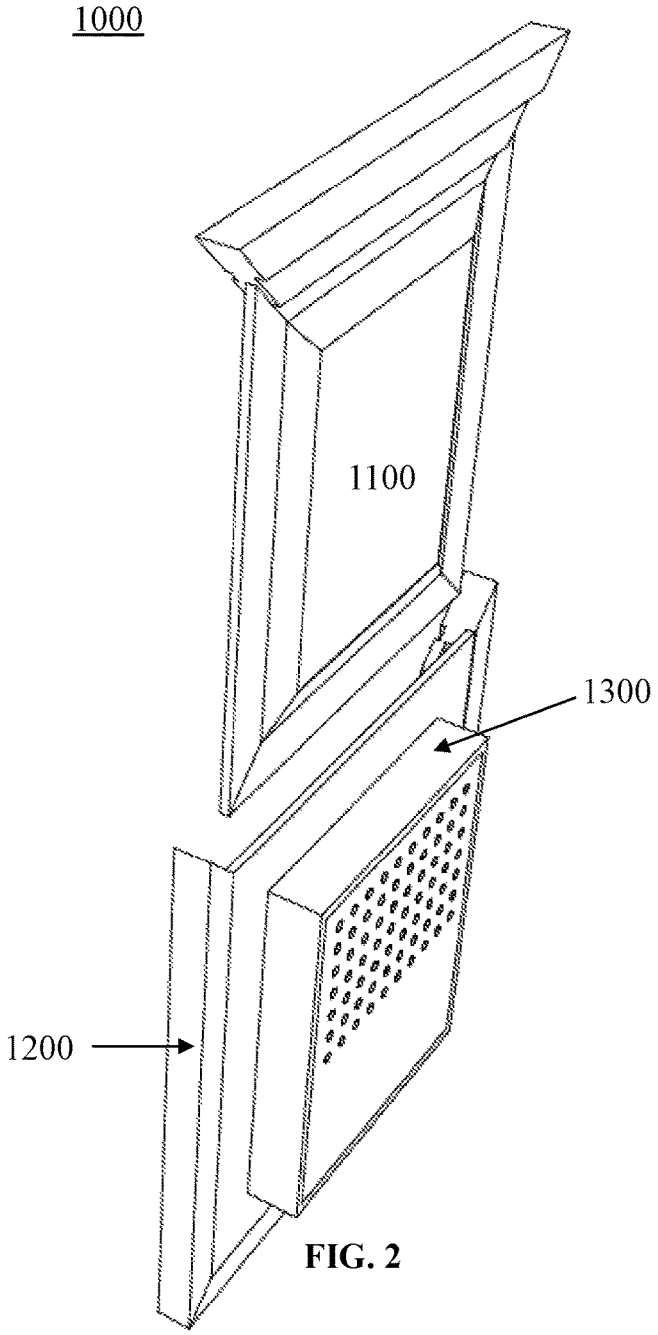
FIG. 2 is a perspective view of system 1000.

FIG. 2 is a perspective view of system 1000, which front cover 1100 and a frame 1200 slidably separated. System 1000 comprises a cabinet 1300 in which objects can be stored.

Figure 3:
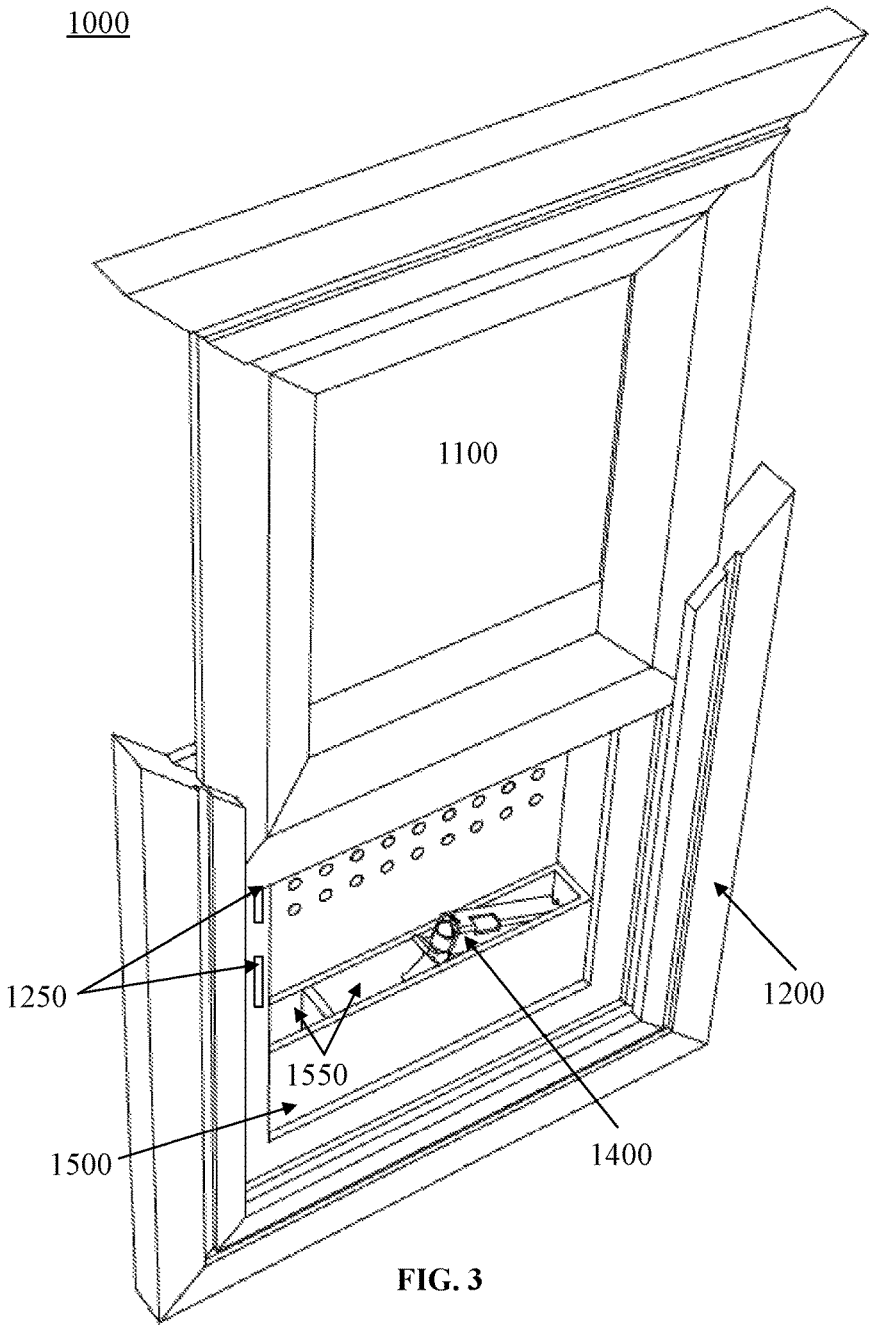
FIG. 3 is a perspective view of system 1000.

FIG. 3 is a perspective view of system 1000 with front cover 1100 open relative to frame 1200. Front cover 1100 can be held partially opened relative to frame 1200 via compressible catches 1250. System 1000 further comprises a drawer 1500, which can define one or more compartments 1550. An object 1400 can be stored in drawer 1500 as illustrated. In the illustrated embodiment, object 1400 is the approximate size and shape of a firearm. When front cover 1100 is opened, as illustrated, drawer 1500 swings forward allowing a user quick and convenient access to object 1400. Drawer 1500 is designed to swing forward as a result of pivots via which drawer 1500 is mounted and a weight distribution of drawer 1500.

Figure 4:
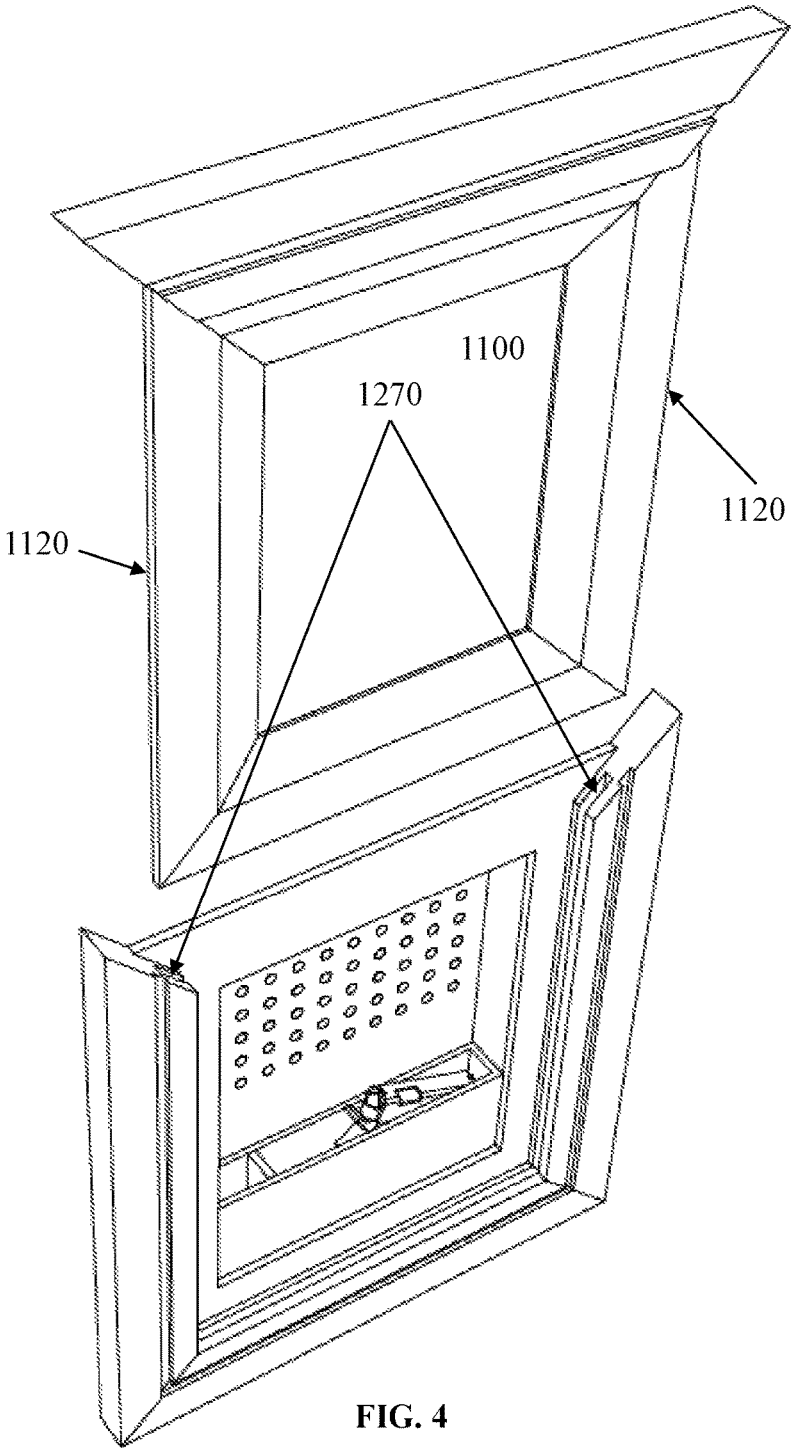
FIG. 4 is a perspective view of system 1000.

FIG. 4 is a perspective view of system 1000 when front cover 1100 is completely removed from the rest of system 1000. Front cover 1100 comprises a pair of tongues 1120 (one along each edge), which engage with a corresponding pair of grooves 1270 of frame 1200.

Figure 5:
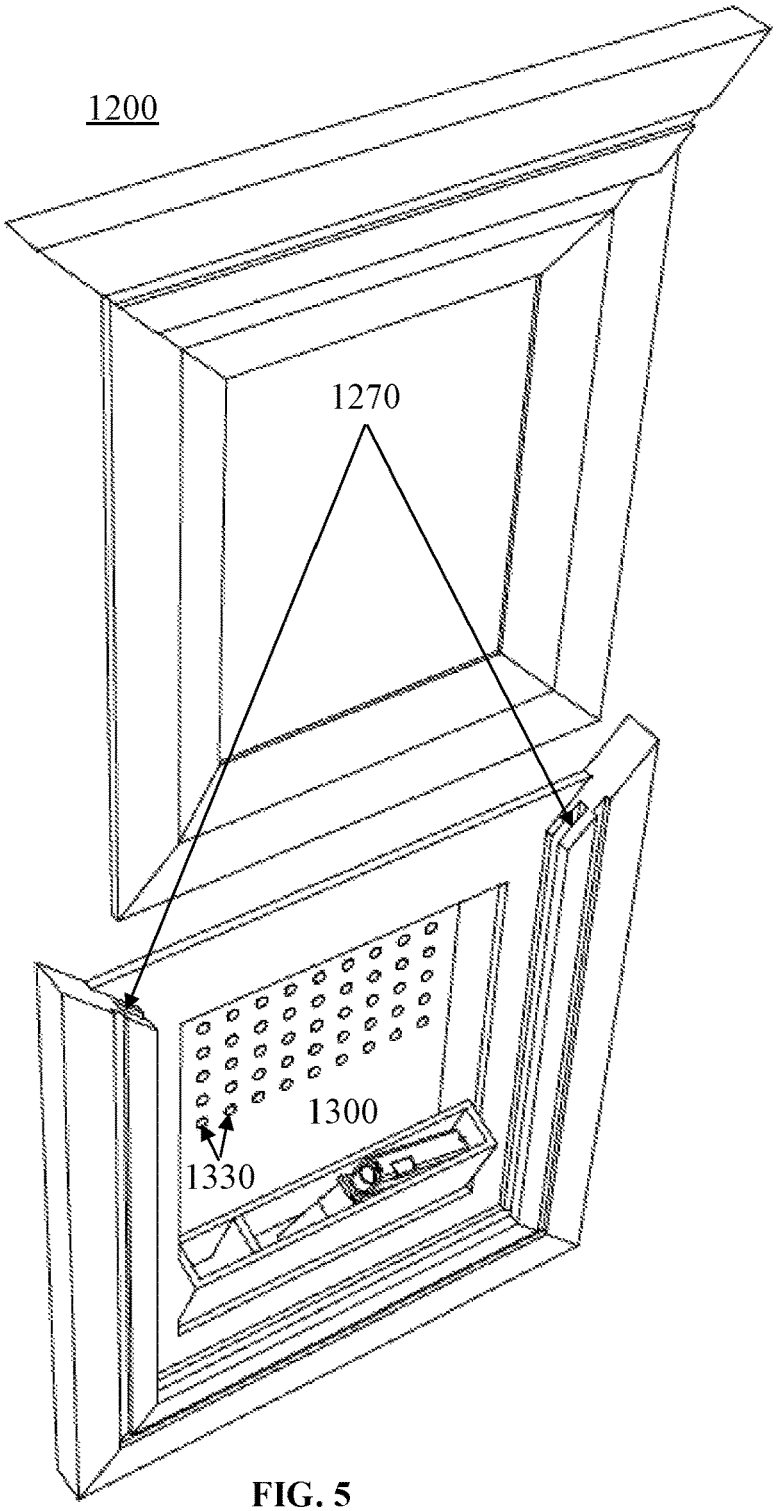
FIG. 5 is a perspective view of system 1000.

FIG. 5 is a perspective view of system 1000. Frame 1200 defines a pair of grooves 1270 that engage with corresponding tongues (e.g., tongues 1120 of FIG. 4) to releasably couple front cover 1100 to frame 1200. Cabinet 1300 can define a plurality of apertures 1330. A plurality of pins (see, e.g., pins 7370 of FIG. 11) can be placed in selected apertures of plurality of apertures 1330. The user can hang one or more desired objects on the plurality of pins to store desired objects in cabinet 1300.

Figure 6:
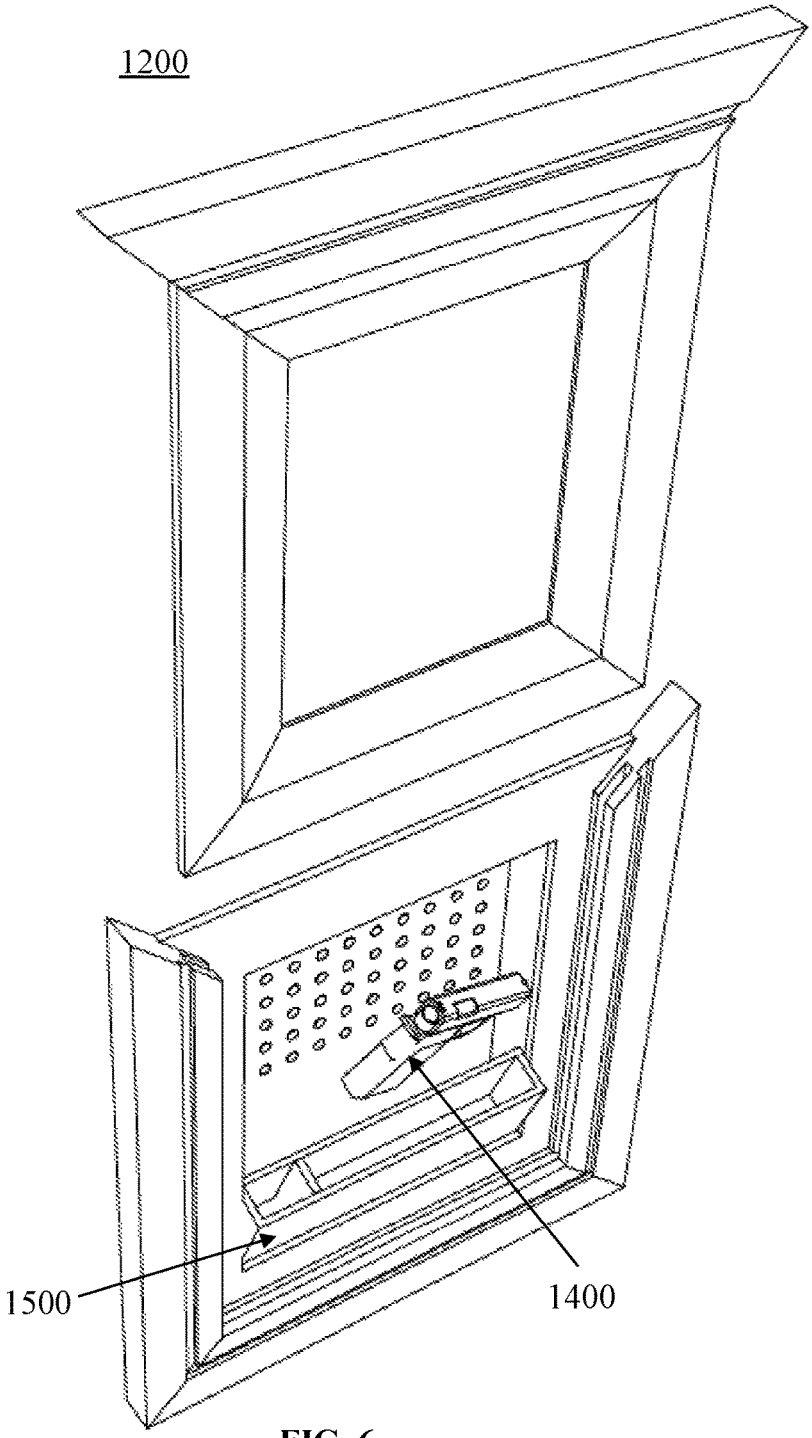
FIG. 6 is a perspective view of system 1000.

FIG. 6 is a perspective view of system 1000, which illustrates object 1400 elevated above drawer 1500.

Figure 7:
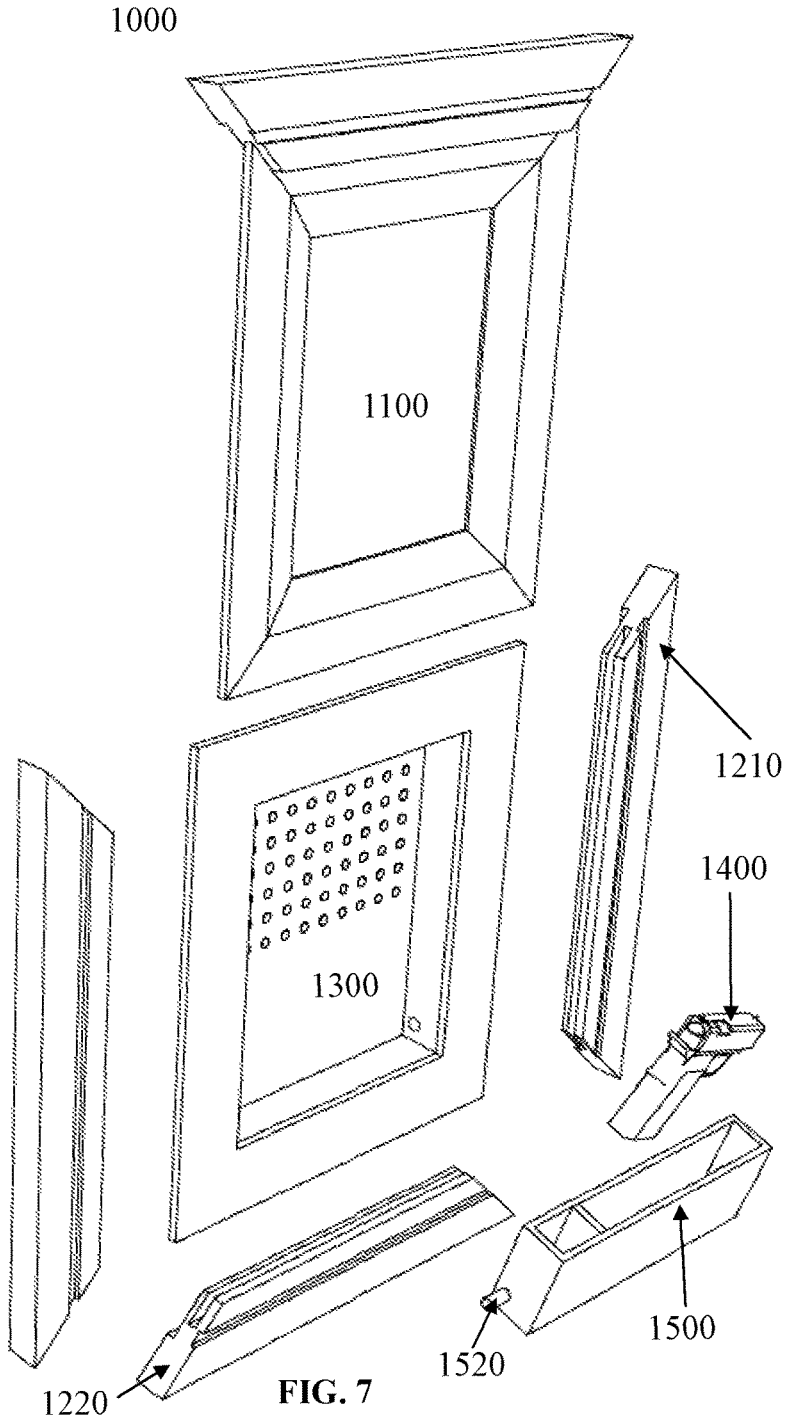
FIG. 7 is a perspective view of system 1000.

FIG. 7 is a perspective view of exploded parts of system 1000, which comprises front cover 1100, cabinet 1300, object 1400, and drawer 1500. Drawer 1500 can be coupled to system 1000 via a pair of pivots 1520 on opposing sides of drawer 1500. Frame 1200 (see frame 1200 as called out in FIG. 3) comprises a pair of opposing sides 1210 and a base 1220.

System 1000 comprises:

- frame 1200 (see frame 1200 as called out in FIG. 3);
- slidable front cover 1100;
- cabinet 1300, which can define at least one or a plurality of apertures (see plurality of apertures 1330 called out in FIG. 5);
- drawer 1500 coupled to cabinet 1300; and/or
- at least one peg, the at least one peg constructed to engage with one of a plurality of apertures defined by the cabinet such that a second object is supportable by the at least one peg In certain exemplary embodiments, when slidable front cover 1100 is lifted to a predetermined position, drawer 1500 rotates to expose a first object 1400 placed in drawer 1500. First object 1400 can be a firearm.

Drawer 1500 can be coupled to cabinet 1300 via a pair of pivots 1520 and rotates relative to cabinet 1300 responsive to a weight distribution of the drawer when slidable front cover 1100 is lifted relative to frame 1200.

Figure 8:
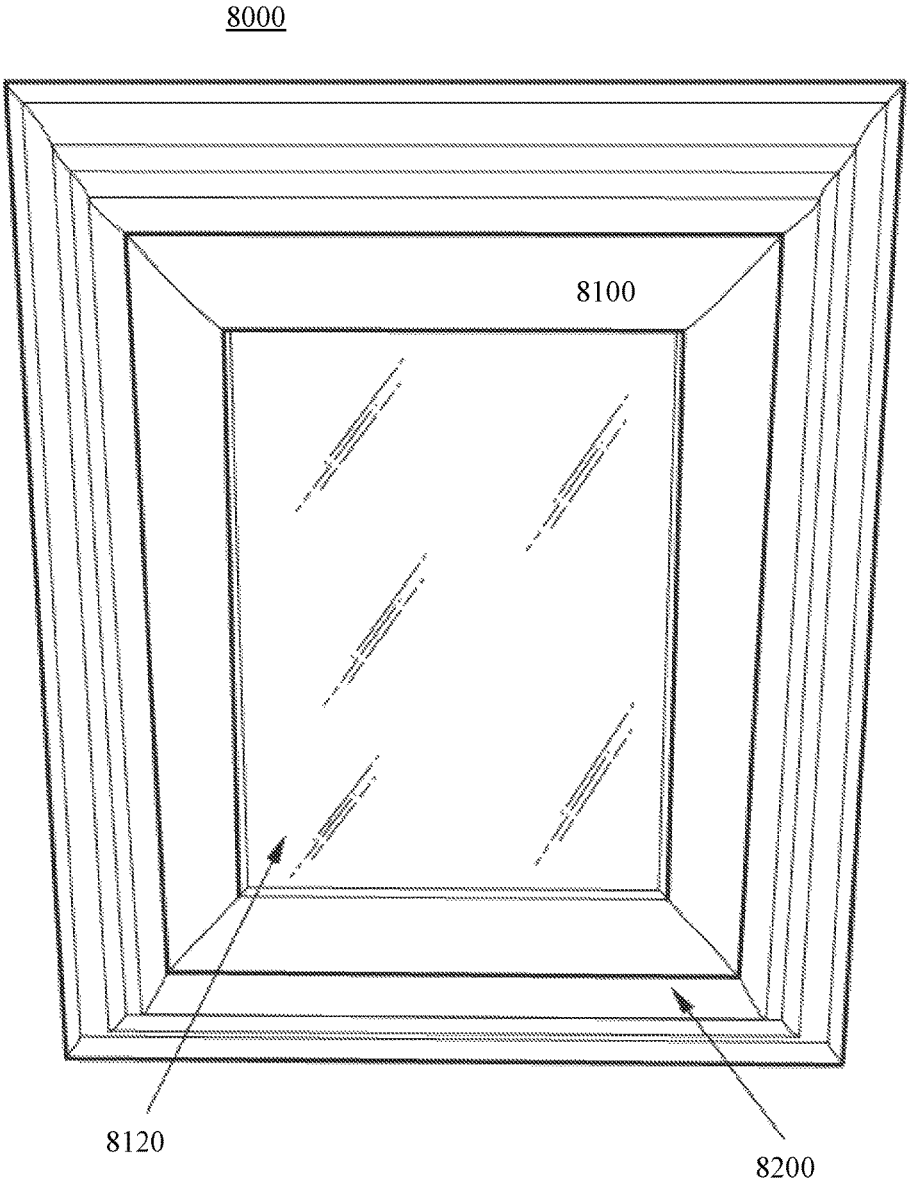
FIG. 8 is a perspective view of an exemplary embodiment of a system 8000.

FIG. 8 is a perspective view of an exemplary embodiment of a system 8000, which comprises a front cover 8100 and a frame 8200. Front cover 8100 and frame 8200 can be slidably coupled via a tongue and groove design. System

8000 comprises a mirror 8120. Other embodiments can utilize a painting or photograph to conceal the object (e.g., handgun).

Figure 9:
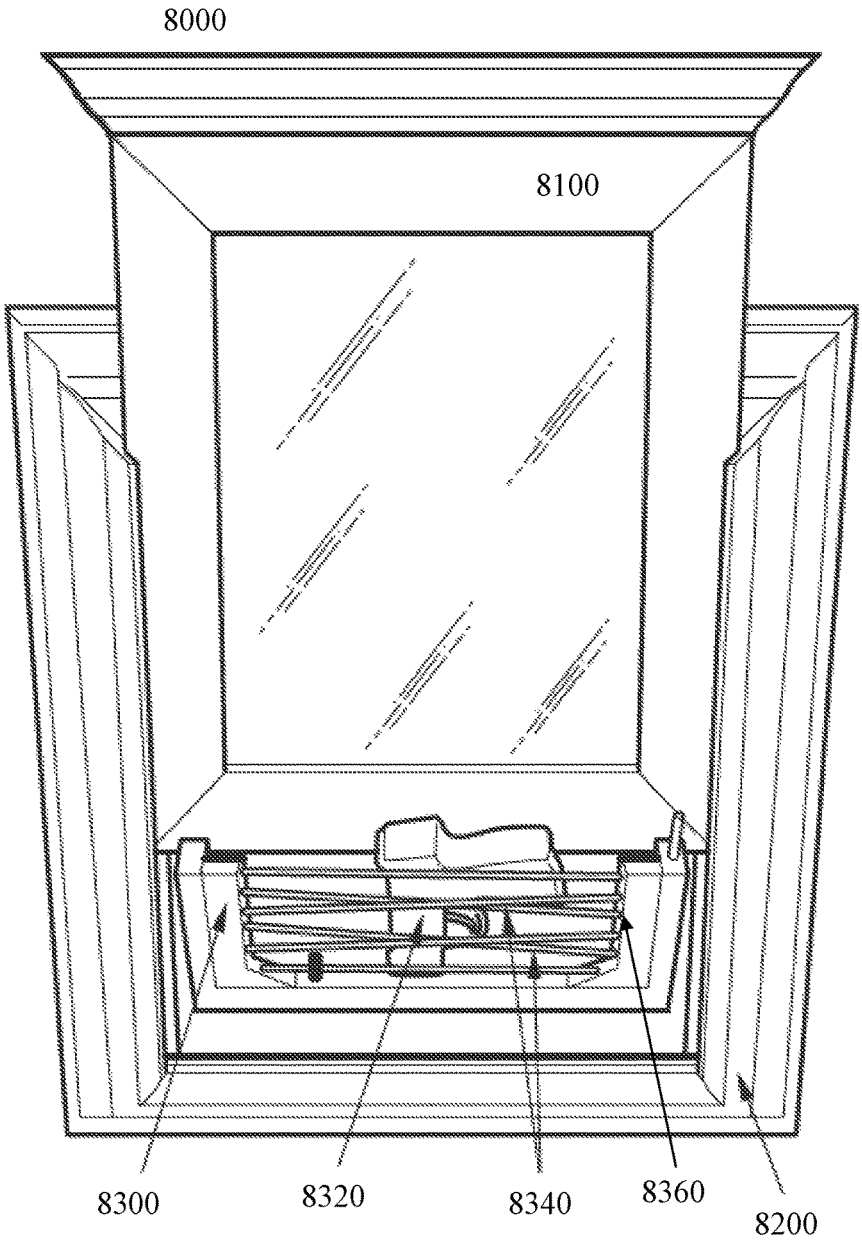
FIG. 9 is a perspective view of system 8000.

FIG. 9 is a perspective view of system 8000 with front cover 8100 partially open, which shows frame 8200 and a drawer 8300 in which objects can be stored. As front cover 8100 is raised, drawer 8300 swings out exposing an object 8320 such that object 8320 can be quickly removed by a user. Object 8320 can be restrained in drawer 8300 as drawer 8300 rotates forward via a plurality of cords 8340.

In certain exemplary embodiments, drawer 8300 comprises an object frame that supports plurality of cords 8340, wherein plurality of cords 8340 are constructed to retain first object 8320. Drawer 8300 can comprise an object frame 8360 that supports plurality of cords 8340, wherein:

plurality of cords 8340 are constructed to retain first object 8320; and a prong (see, e.g., prong 14800 of FIG. 14), which can be a magnetic prong, can be coupled to object frame 8360; first object 8320 can be a firearm, and the prong can be constructed to engage with a barrel of the firearm and attract the barrel if the prong is magnetic and the barrel is of a material attracted to magnets.

In certain exemplary embodiments, drawer 8300 comprises one or more compartments (see, e.g., compartments 1550 called out in FIG. 3), each of which is substantially enclosed on at least three sides.

Slidable front cover 1100 engages with frame 1200 via a tongue and groove. The object can be a firearm. In certain exemplary embodiments, frame 1200 can support a mirror. In certain exemplary embodiments, frame 1200 can support a picture. In certain exemplary embodiments, frame 1200 resembles a household cabinet.

Figure 10:
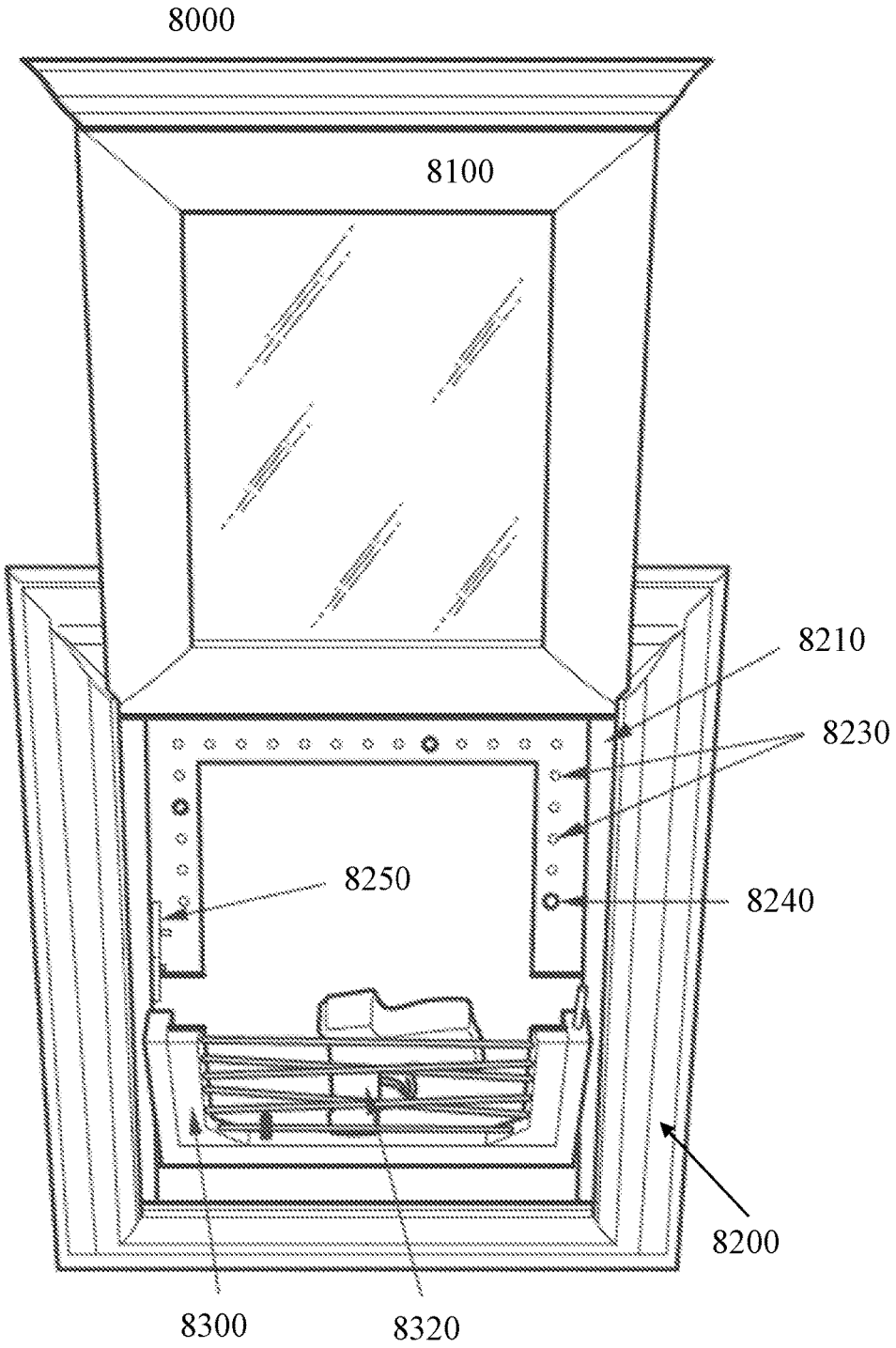
FIG. 10 is a perspective view of system 8000.

FIG. 10 is a perspective view of system 8000 with a front cover mostly open. Front cover 8100 can be held partially opened relative to frame 8200 via one or more compressible catches 8250. Object 8320 can be stored in drawer 8300 as illustrated. In the illustrated embodiment, object 8320 is the approximate size and shape of a firearm. When front cover 8100 is opened, as illustrated, drawer 8300 swings forward allowing a user quick and convenient access to object 8320.

System 8000 can comprise a board 8210, which defines a plurality of apertures 8230. A peg 8240 can be inserted into a selected aperture of plurality of apertures 8230. Peg 8240 can be used to hang a small object for storage behind front cover 8100. Other similar pegs can be inserted into other apertures of plurality of apertures 8230 to allow other small objects to be coupled thereto.

Figure 11:
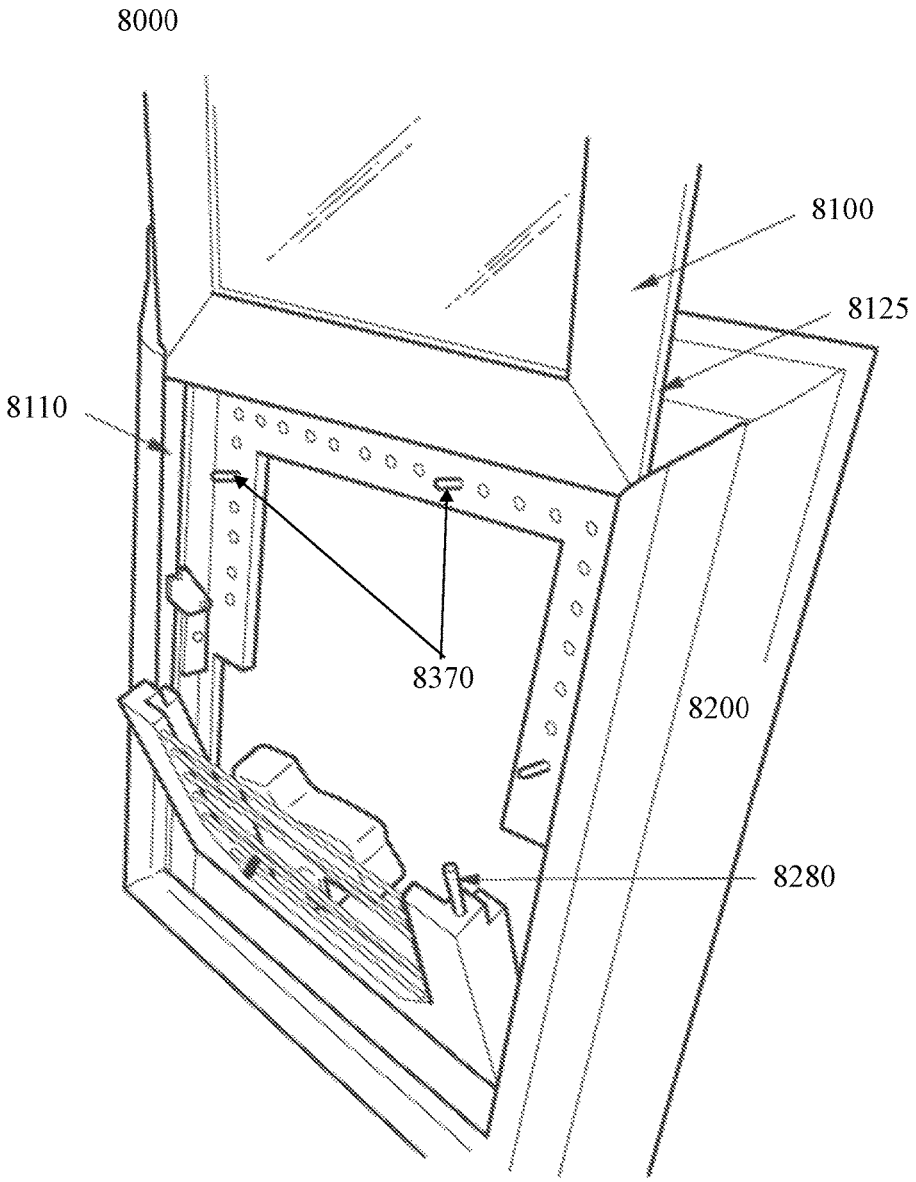
FIG. 11 is a perspective view of system 8000.

FIG. 11 is a perspective view of system 8000. Front cover 8100 comprises a pair of tongues 8125 (one along each edge—one of which is visible in FIG. 11), which engage with a corresponding pair of grooves 8110 of frame 8200. System 8000 further comprises a dowel pin 8280, which can be used to hang a small object for storage within system 8000 for concealment behind front cover 8100.

Figure 12:
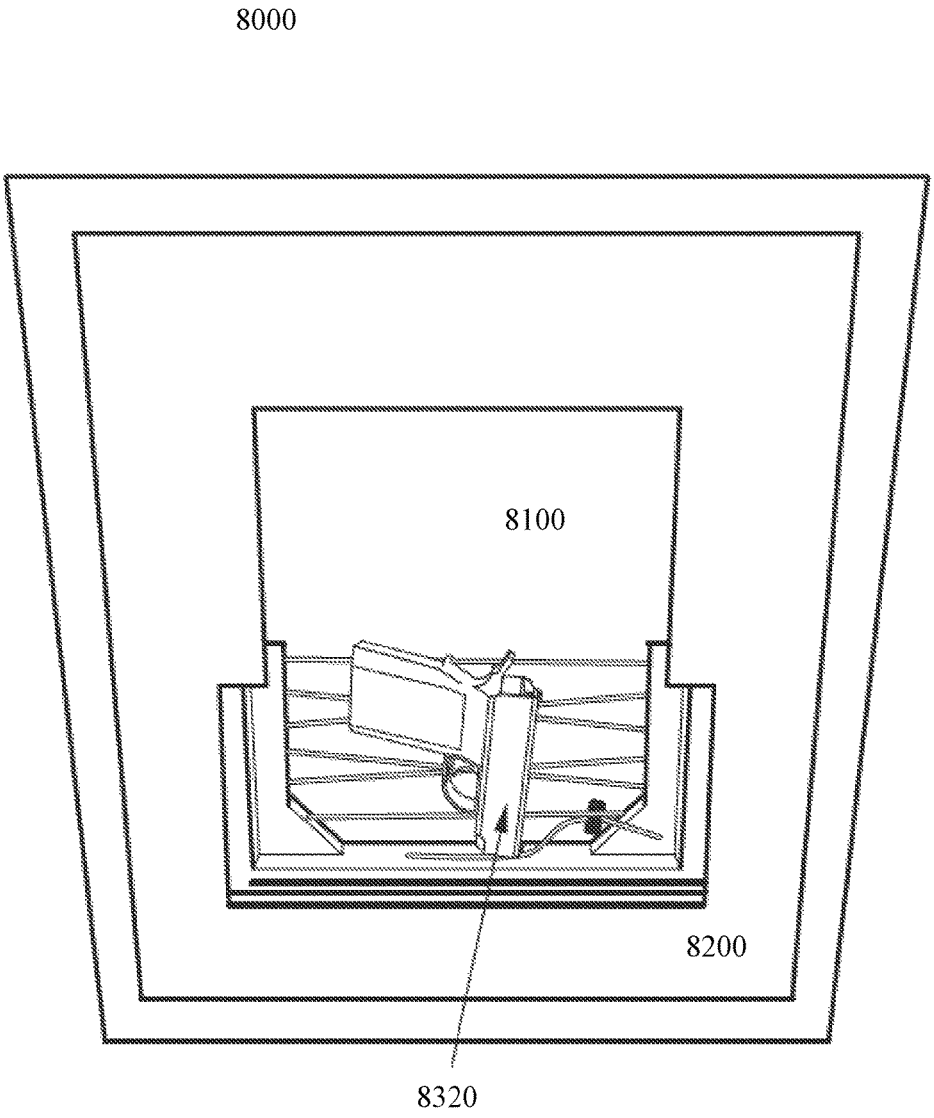
FIG. 12 is a perspective view of system 8000.

FIG. 12 is a perspective view of system 8000, which illustrates storage of object 8320 in system 8000 when front cover 8100 is substantially closed. As illustrated, object 8320 is kept within the confines of system 8000 via a wall upon which system 8000 is mounted. As such, when system 8000 is mounted to the wall, there is no need for additional support for object 8320 in order for object 8320 to remain within system 8000.

Figure 13:
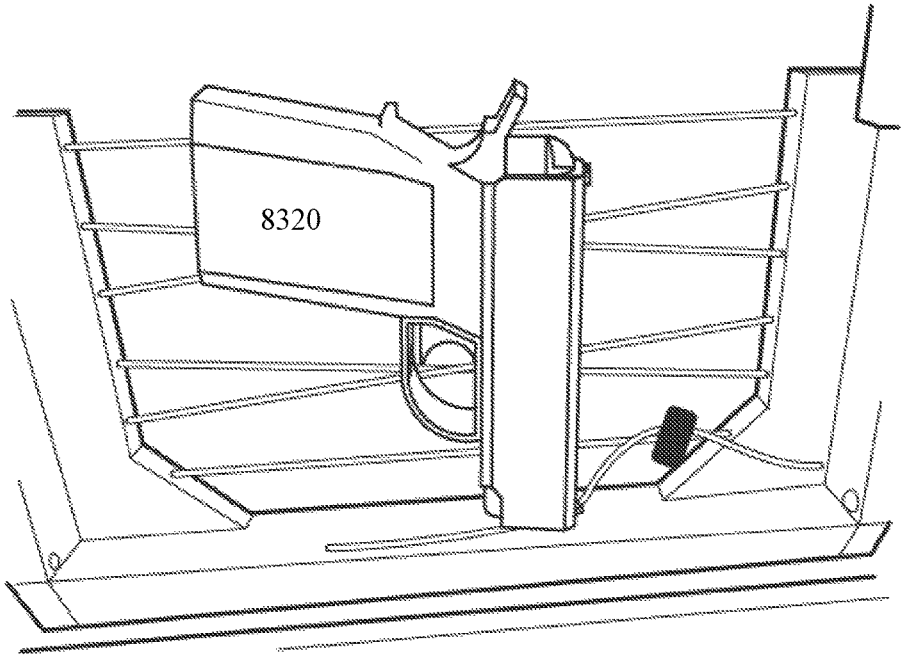
FIG. 13 is a perspective view of system 8000.

FIG. 13 is a perspective view of system 8000, which shows a close-up view of object 8320 retained by system 8000.

Figure 14:
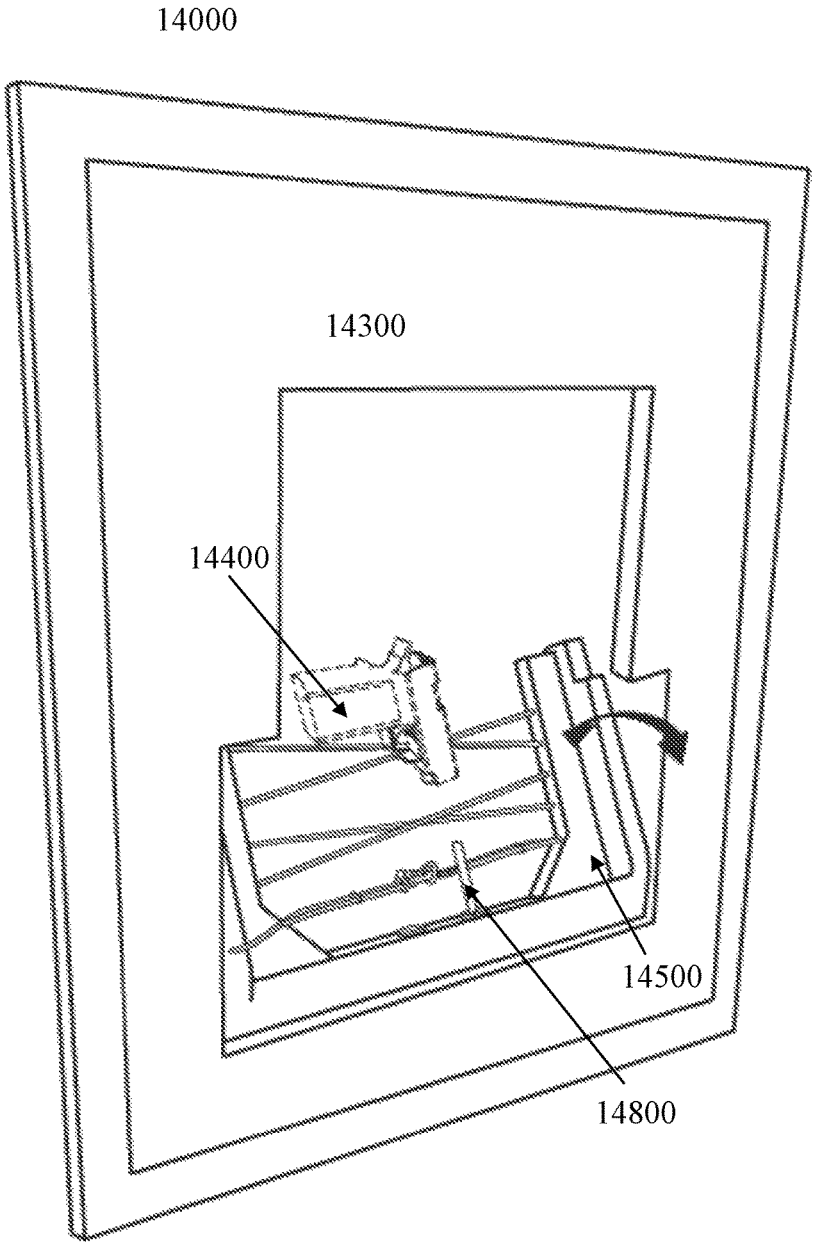
FIG. 14 is another perspective view of an exemplary embodiment of system 14000.

FIG. 14 is another perspective view of an exemplary embodiment of system 14000. System 14000 comprises a prong 14800 via which object 14400 can be retained in system 14000. In certain exemplary embodiments, prong 14800 is magnetic. When prong 14800 is magnetic and object 14400 is made of a material attracted to magnets, a magnetic force assists in restraining motion of object 14400 relative to cabinet 14300 and/or drawer 14500. Drawer 14500 rotates relative to cabinet 14300 as a front cover of system 14000 is slid upward relative to cabinet 14300.

Figure 15:
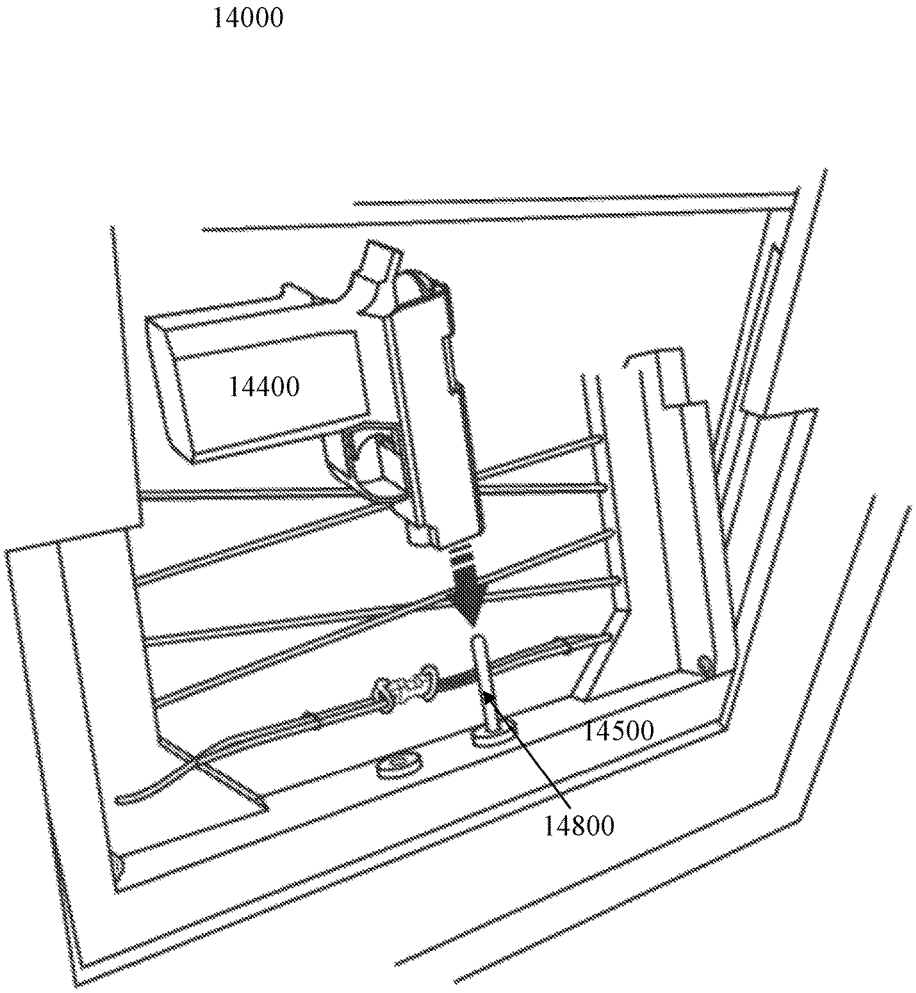
FIG. 15 is a magnified view of a portion of system.

FIG. 15 is a magnified view of a portion of system 14000, which illustrates object 14400 moving toward being placed in drawer 14500. Prong 14800 assists in restraining motion of object 14400 when object 14400 is placed upon prong 14800.

Figure 16:
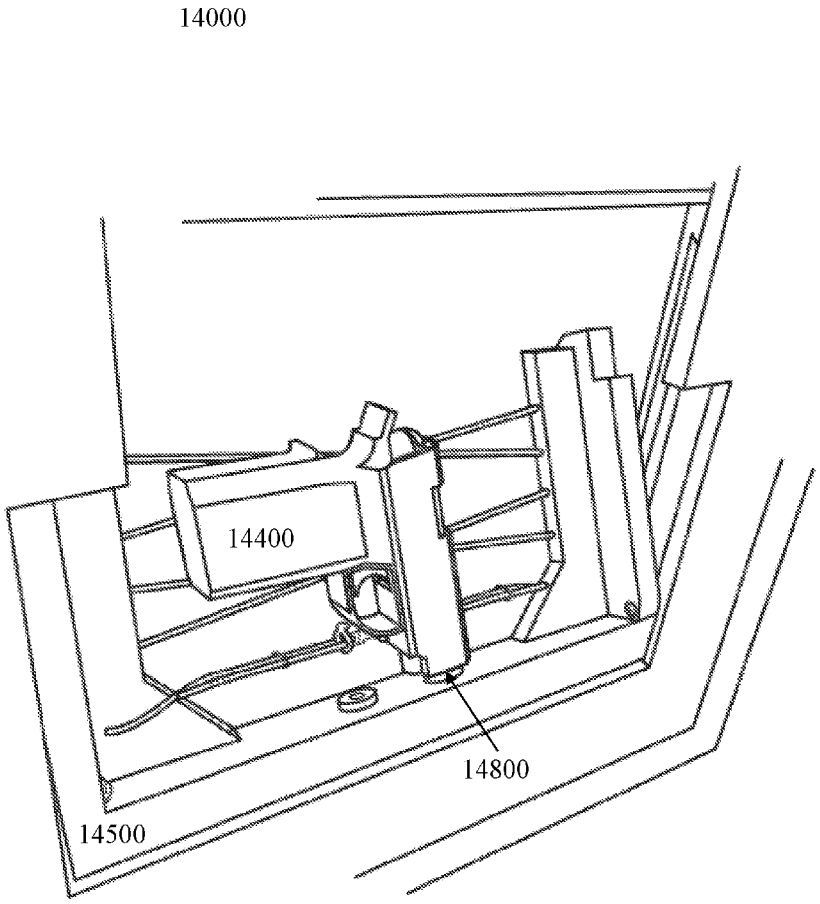
FIG. 16 is a magnified view of a portion of system.

FIG. 16 is a magnified view of a portion of system 14000, which illustrates object 14400 coupled to drawer 14500 via prong 14800.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

and/or—either in conjunction with or in alternative to.

aperture—an opening in something.

apparatus—an appliance or device for a particular purpose associate—to join, connect together, and/or relate.

barrel—a tube of a gun through which a bullet is fired.

base—a portion of a frame that is coupled to a pair of sides and engages with a cabinet and slidable cover.

cabinet—a piece of furniture constructed to mount to a wall that has an appearance of not comprising a compartment.

can—is capable of, in at least some embodiments.

catch—a piece of an object that can restrain motion of the object relative to another object.

compartment—a space that is partitioned off.

comprising—including but not limited to.

configure—to make suitable or fit for a specific use or situation.

connect—to join or fasten together.

constructed to—made to and/or designed to.

cord—a structure resembling a rope or string that can be wrapped around solid objects to form a web.

coupleable—capable of being joined, connected, and/or linked together.

coupling—linking in some fashion.

cover—a face that covers a cabinet opening.

define—to establish the outline, form, or structure of device—a machine, manufacture, and/or collection thereof.

dowel pin—a type of fastener used to hold an object in place.
drawer—a receptacle in a cabinet constructed to retain an object.
enclosed—substantially surrounded.
expose—to uncover something.
firearm—a small arms weapon, as a pistol, from which a projectile is fired by gunpowder.
frame—a rigid structure joined so as to surround a substantially empty space, and used as a support for other parts of the rigid structure.
household—a residence.
install—to connect or set in position and prepare for use.
lift—to raise upward.
magnetic—capable of being attracted by a magnetic field.
may—is allowed and/or permitted to, in at least some embodiments.
method—a process, procedure, and/or collection of related activities for accomplishing something.
mirror—an object that reflects light in such a way that, for incident light in some range of wavelengths, the reflected light preserves many or most of the detailed physical characteristics of the original light.
object—a tangible thing.
object frame—a frame comprised by an objet
peg—a pin of wood or other material that can be fitted into something, as to hang things on.
picture—an image, illustration, or drawing that is mounted in a display frame.
place—to put in a particular location and/or position.
plurality—the state of being plural and/or more than one.
position—a place occupied by something.
predetermined—established in advance.
provide—to furnish, supply, give, and/or make available.
prong—a pin projecting from a surface.
repeatedly—again and again; repetitively.
resembles—looks substantially like.
responsive—reacting to an influence and/or impetus.
rotate—to turn about an axis.
set—a related plurality.
slidable—constructed to move along in substantially continuous contact with a surface
substantially—to a great extent or degree.
support—to bear the weight of, especially from below.
system—a collection of mechanisms, devices, machines, articles of manufacture, processes, data, and/or instructions, the collection designed to perform one or more specific functions.
tongue and groove—a construction via which two objects are releasably coupled together. One piece defines a pair of slots (the groove), one groove cut along each of two edges. The other piece has a ridge (the tongue) on each of two opposite edges. Each tongue projects a little less than the depth of the corresponding groove. The two pieces fit together closely as the piece comprising the ridges slides into the piece defining the grooves.
via—by way of and/or utilizing.
wall—a vertical construction with a length and height greater than a thickness and is used to at least partially enclose.
weight distribution—how mass is apportioned within an object.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:
a frame;
a slidable cover;
a cabinet; and a drawer coupled to the cabinet, wherein, when the slidable cover is lifted to a predetermined position, the drawer rotates to expose a first object placed in the drawer.

2. The system of claim 1, further comprising:

the object, wherein the first object is a firearm.

3. The system of claim 1, further comprising:

at least one peg, the at least one peg constructed to engage with one of a plurality of apertures defined by the cabinet such that a second object is supportable by the at least one peg.

4. The system of claim 1, wherein:

the drawer is coupled to the frame via a pair of pivots.

5. The system of claim 1, wherein:

the drawer is coupled to the cabinet via a pair of dowel pins and rotates responsive to a weight distribution of the drawer.

6. The system of claim 1, wherein:

the cabinet defines at least one aperture; and a peg engages with the at least one aperture such that a second object is supportable by the peg.

7. The system of claim 1, wherein:

the drawer comprises an object frame that supports a plurality of cords, wherein the plurality of cords are constructed to retain the first object.

8. The system of claim 1, wherein:

the drawer comprises an object frame that supports a plurality of cords, wherein:

the plurality of cords are constructed to retain the first object; and a prong is coupled to the object frame, the first object is a firearm, and the prong constructed to engage with a barrel of the firearm.

9. The system of claim 1, wherein:

the drawer comprises an object frame that supports a plurality of cords, wherein:

the plurality of cords are constructed to retain the first object; and a magnetic prong is coupled to the object frame, the first object is a firearm, and the magnetic prong is constructed to engage with a barrel of the firearm and attract the barrel if magnetic.

10. The system of claim 1, wherein:

the drawer comprises a compartment that is substantially enclosed on at least three sides.

11. The system of claim 1, wherein:

the drawer comprises a plurality of compartments, each of the plurality of compartments substantially enclosed on at least three sides.

12. The system of claim 1, wherein:

the slidable cover engages with the frame via a tongue and groove.

13. The system of claim 1, wherein:

the object is a firearm.

14. The system of claim 1, wherein:

the frame supports a mirror.

15. The system of claim 1, wherein:

the frame supports a picture.

16. The system of claim 1, wherein:

the frame resembles a household cabinet.

* * * * *